US009789409B1

(12) United States Patent
Yakos et al.

(10) Patent No.: US 9,789,409 B1
(45) Date of Patent: Oct. 17, 2017

(54) RECREATIONAL SWING

(71) Applicant: Plow & Hearth, LLC, Madison, VA (US)

(72) Inventors: David Yakos, Bozeman, MT (US); Kirk Turner, Bozeman, MT (US); Beverly Fries, Baboursville, VA (US); Ting Xu, Richmond, VA (US)

(73) Assignee: Plow & Hearth, LLC, Madison, VA (US)

( * ) Notice: Subject to any disclaimer, the term of this patent is extended or adjusted under 35 U.S.C. 154(b) by 0 days.

(21) Appl. No.: 15/250,148

(22) Filed: Aug. 29, 2016

(51) Int. Cl.
*A63G 9/12* (2006.01)
*A63G 9/14* (2006.01)
*A47D 13/00* (2006.01)

(52) U.S. Cl.
CPC *A63G 9/14* (2013.01); *A63G 9/12* (2013.01)

(58) Field of Classification Search
CPC ... A63G 9/00; A63G 9/12; A63G 9/14; A63G 13/00; A63G 13/02; A47D 13/00; A47D 13/105; A47D 13/107; A47D 9/02; A47C 7/02; A47C 7/021
USPC ..... 472/118, 120–125; 297/219.1, 228.11, 297/440.22
See application file for complete search history.

(56) References Cited

U.S. PATENT DOCUMENTS

| | | | | |
|---|---|---|---|---|
| 3,220,767 | A * | 11/1965 | Hendrickson | A47C 7/021 297/228.12 |
| 5,624,321 | A | 4/1997 | Snyder | |
| 5,984,792 | A * | 11/1999 | Clark | A63G 9/14 472/118 |
| 8,083,600 | B2 * | 12/2011 | Sheets | A63G 9/00 297/273 |
| 8,672,770 | B2 | 3/2014 | Matt | |
| 2014/0162797 | A1 * | 6/2014 | Priest | A63G 9/14 472/118 |

* cited by examiner

*Primary Examiner* — Kien Nguyen
(74) *Attorney, Agent, or Firm* — Jordan IP Law, LLC; Todd A. Vaughn

(57) ABSTRACT

A recreational swing having a seating member to support one or more users thereon, and a suspension system that includes one or more bungee cords that permit the base seating portion to be suspended from a suspension point so as to dually function as a swing.

8 Claims, 7 Drawing Sheets

Bottom

Bottom

RECREATIONAL SWING

TECHNICAL FIELD

Embodiments relate to a recreational swing having a seating member configured to support one or more users thereon, and a suspension system that includes one or more bungee cords that permit the base seating portion to be suspended from a suspension point so as to dually function as a swing. The bungee cords are covered by an outer cover configured so that the bungee cord never extends to its maximum length.

BACKGROUND

Recreational swings that include a seat connected to a suspension system connected to a support that permits the seat to swing in an arcuate motion.

DRAWINGS

DESCRIPTION

As illustrated in FIGS. 1 to 5, in accordance with embodiments, a recreational swing 20 is provided that may be suspended indoors or outdoors at a suspension point in order to serve both as a swing and/or a hanging chair for leisure for one or more users.

Figure 1:
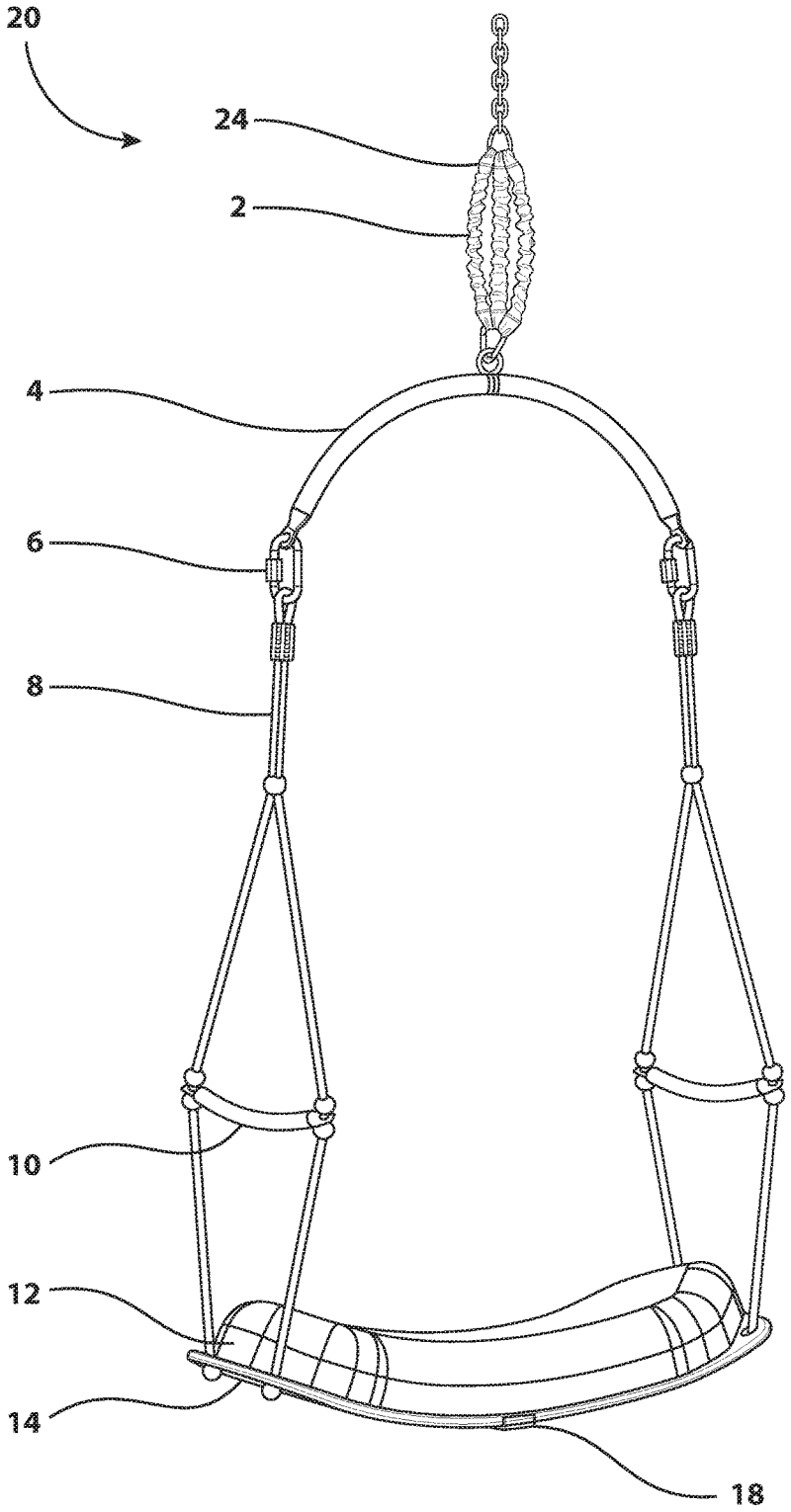
FIG. 1 illustrates an isometric view of a recreational swing, in accordance with embodiments.
Figure 5:
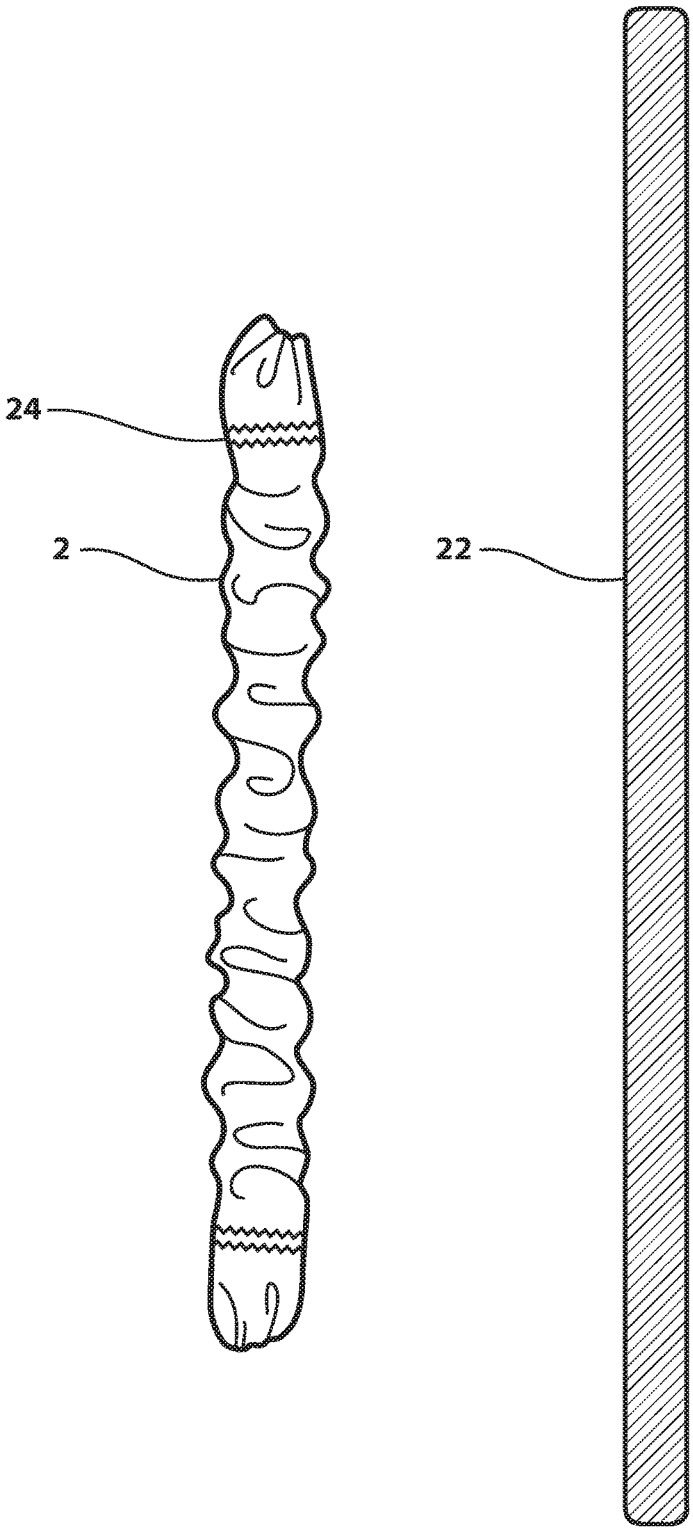
FIG. 5 illustrates an exploded view of a spring member, in accordance with embodiments.
Figure 6:
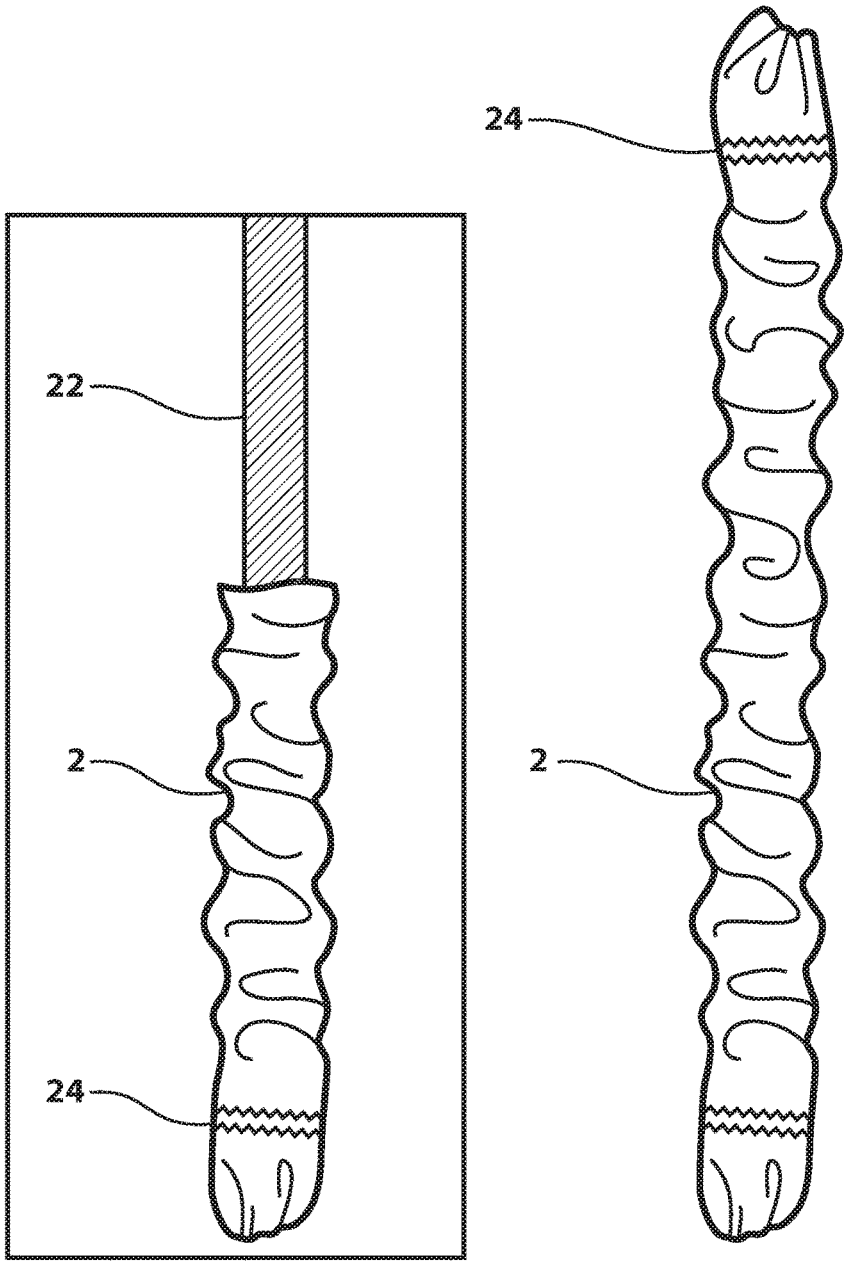
FIG. 6 illustrates an exploded view of a spring member, in accordance with embodiments.

As illustrated in FIGS. 1 and 5, the swing 20 includes a seating member having a base seat portion 12 and a support seat portion 14 to support the base seat portion 14, a suspension system connected to the base seating area to permit the seating member to be placed in a suspended position. The suspension system includes a support cross bar 4, first suspension members 8 each connected at a first end thereof to the base seat portion 14 and at a second end to the support cross bar 4 via links 6, and a second suspension member 2 extending between and connected to the support cross bar 4 and a suspension point to permit the seating member, when in a suspended position and occupied by at least one user, to move in a vertical plane and a lateral plane with respect to a suspension point.

Figure 7:
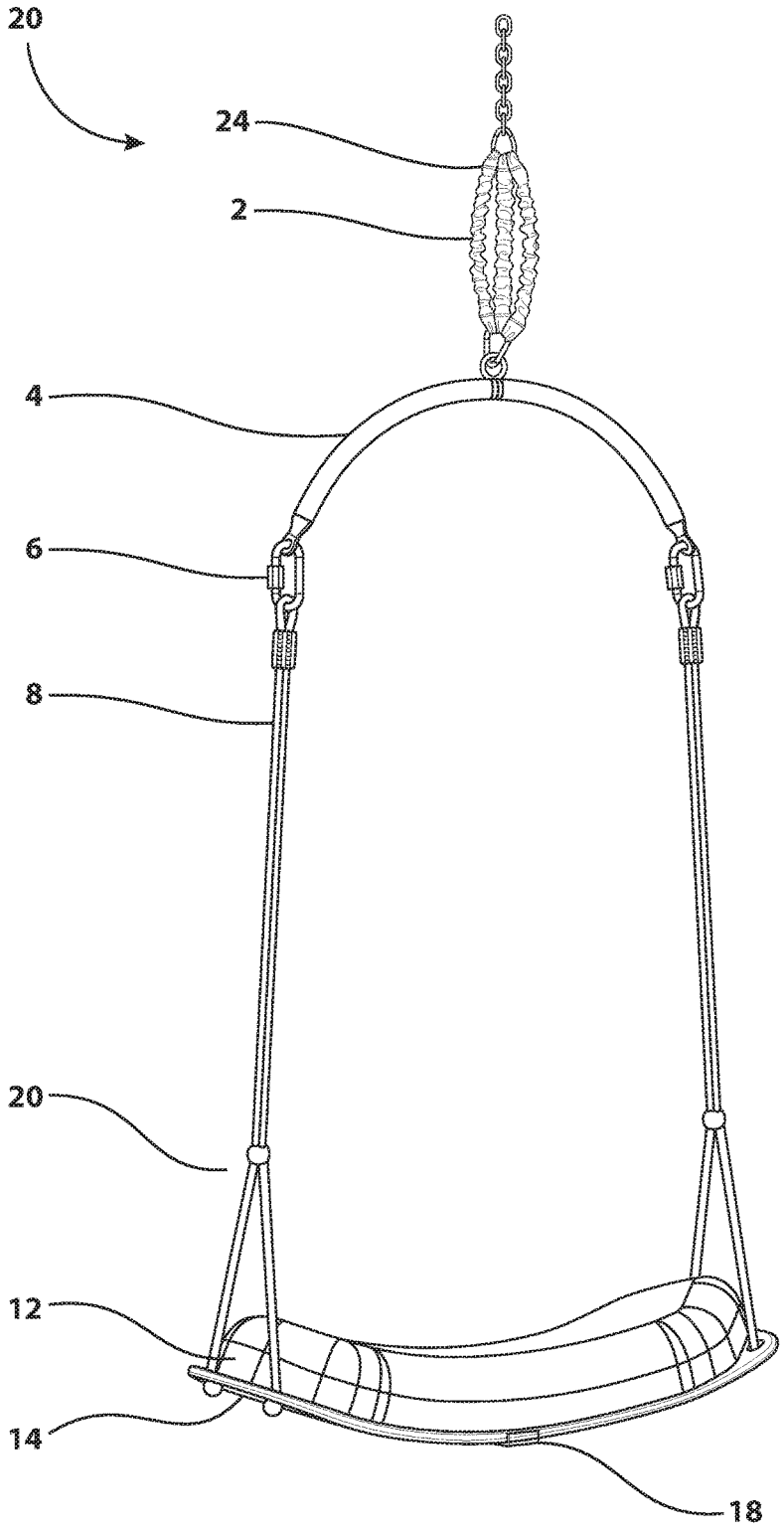
FIG. 7 illustrates an isometric view of a recreational swing, in accordance with embodiments.

As illustrated in FIGS. 1 and 7, the cross bar 4 is to receive at opposite ends thereof mechanical connectors such as, for example, links 6 that may be directly connected to the first suspension members 8. Embodiments, however, are not limited thereto and may encompass other types of connections that will fall within the spirit and scope of the principles of this disclosure.

Figure 2:
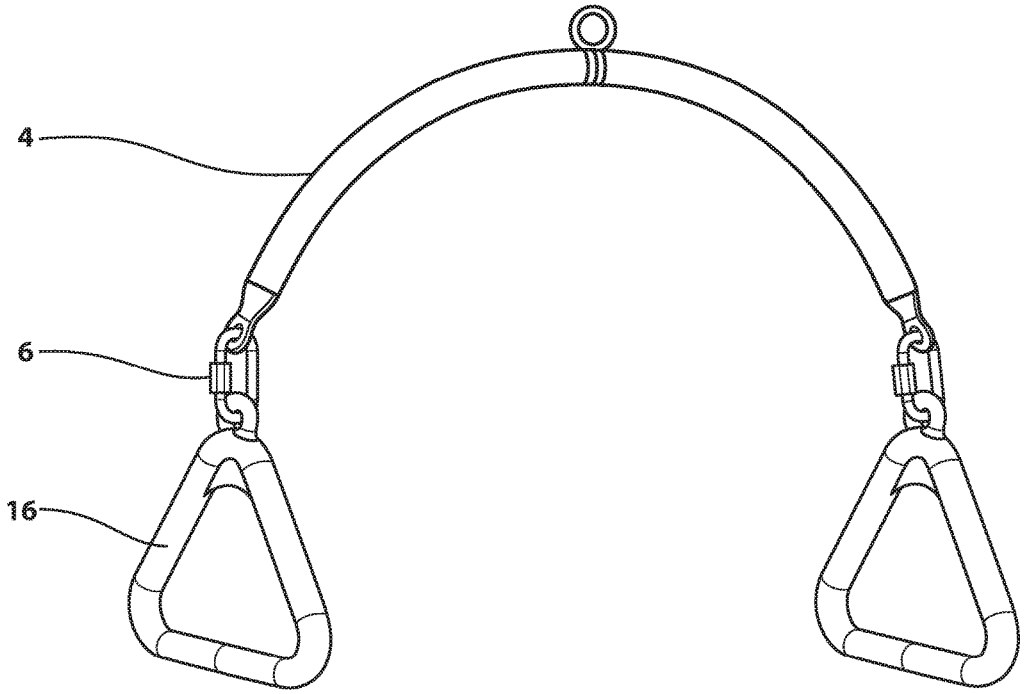
FIG. 2 illustrates an isometric view of a support cross bar for a recreational swing, in accordance with embodiments.

As illustrated in FIG. 2, alternatively, the swing 20 may be formed such that the links 6 are connected to handles or rings 16 that permit a user to use the swing 20 without the seating member 12, 14. For example, a user may have the ability to hang from the rings 16 and bounce without use of the seating member 12, 14. The handles/rings 16 may be geometrically shaped to permit connection of the cross bar 4 to the first suspension members 8.

Figure 3:
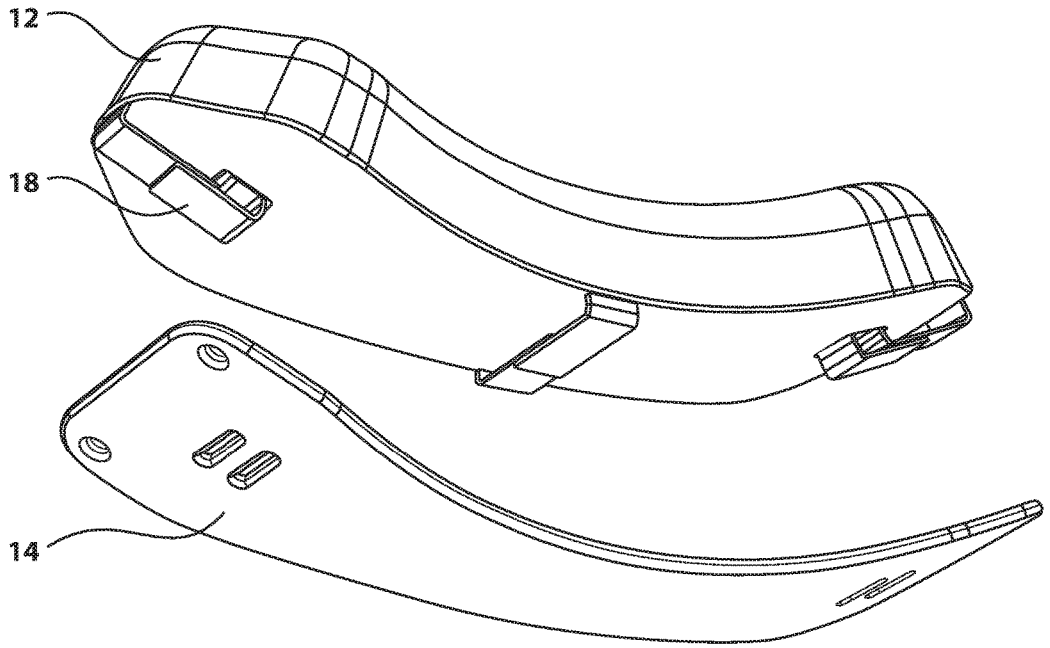
FIG. 3 illustrates an bottom view of a base seating portion of a recreational swing, in accordance with embodiments.
Figure 4:
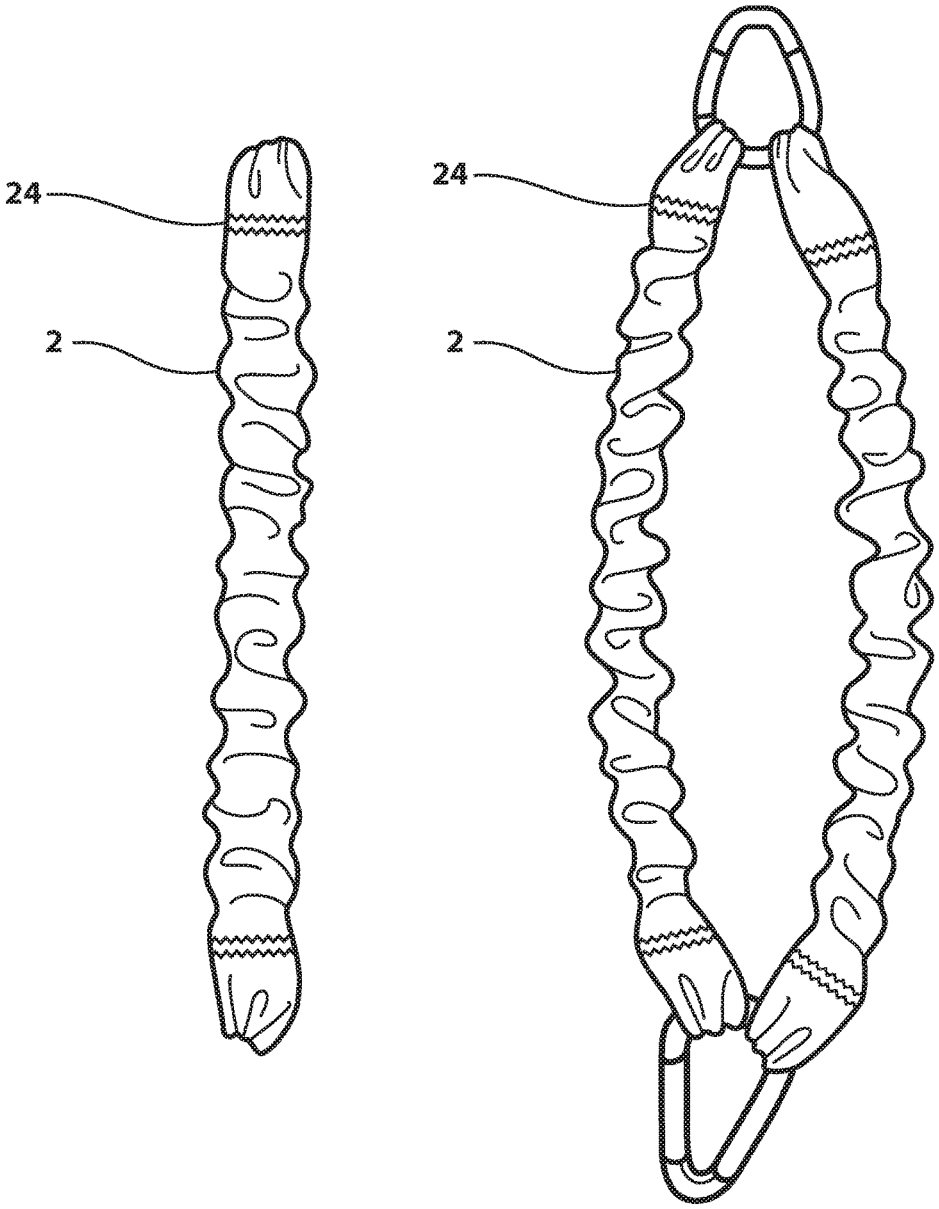
FIG. 4 illustrates an isometric view of a bungee assembly of a recreational swing, in accordance with embodiments.

As illustrated in FIGS. 1, 3, and 7, the base seat portion 12 may comprise a foam base that has an outer covering of a flexible material such as, for example, vinyl. The base seat portion 12 may comprise a vinyl coated foam. Embodiments, however, are not limited thereto and may encompass other materials that will fall within the spirit and scope of the principles of this disclosure. A bottom surface of the base seat portion 12 includes at least one securing member 18 that permits a removable attachment or connection of the base seat portion 12 to the support seat portion 14. In one embodiment, the securing member 18 may comprise spaced apart first and second straps 18 at longitudinal ends of the base seat portion 12, and an intermediary third strap 18 between the first and second straps 18. Embodiments, however, are not limited thereto and may encompass other types of securing members that will fall within the spirit and scope of the principles of this disclosure.

The support seat portion 14 may be composed of a polymer material such as, for example, a high density polyethylene material. Embodiments, however, are not limited thereto and may encompass other materials that will fall within the spirit and scope of the principles of this disclosure. The support seat portion 14 may comprise at least one receiving member. In one embodiment, the receiving member comprises a plurality of slots at longitudinal ends thereof that receives a corresponding one of the first and second straps 18 to permit a removeable, mechanical attachment/connection to the base seat portion 12 along the longitudinal axis of the support seat portion 14. The third strap 18 does not have a corresponding slot, but instead is to wrap around the support seat portion 14 along the lateral axis of the support seat portion 14. Advantageously, the base seat portion 12 and the support seat portion 14 may be securely connected along both the longitudinal and lateral axes.

The first, second, and third straps 18, for example, may comprise, for example, Velcro™ nylon straps provided on an inner surface thereof that are connectable to corresponding Velcro™ nylon straps on an outer surface thereof. Embodiments, however, are not limited thereto and may encompass other types of connections that will fall within the spirit and scope of the principles of this disclosure.

While embodiments illustrate a bifurcated design of the seating member, embodiments are not limited to such a configuration, and may encompass other configurations that will fall within the spirit and scope of the principles of this disclosure. For example, the base seat portion 12 and the support seat portion 14 may be combined to form a single, unitary design having the same properties.

As illustrated in FIGS. 1 and 7, the first suspension members 8 may each comprise a rope or cord attached to the support seat portion 14 at separate, spaced support points. For example, a first end of the rope/cord may be attached to the support seat portion 14 at a first support point, while a second end thereof may be attached to the support seat portion 14 at a second support point. The first suspension members 8 may be threaded through corresponding holes in the base seat portion 14, and secured with a knot or mechanical locking clasp. Embodiments, however, are not limited thereto and may encompass other types of connections that will fall within the spirit and scope of the principles of this disclosure. For example, the rope of the first suspension member 8 may form a loop that is received into a corresponding hole of a ring in the support seat portion 14.

In accordance with the embodiment illustrated in FIG. 1, the support points may define a space between sections of the rope/cord through which a handle 10 is positioned. The rope or cord may, for example, be composed of a material that is robust, durable, and flexible. Such a material may comprise a polymer material such as polypropylene. Embodiments, however, are not limited thereto and may encompass other materials that will fall within the spirit and scope of the principles of this disclosure. For example, in an embodiment, alternatively, the first suspension members 8 may comprise in entirety elastic members such as bungee cords. For example, in another embodiment, alternatively, the first suspension members 8 may comprise a combination of one portion of the length being composed of a rope/cord, and a remaining portion of the length being composed of an elastic member such as a bungee cord.

As illustrated in FIGS. 1 and 4-7, the second suspension members 2, 22, 24 have a modular design that includes at least one spring member comprising an outer cover member 2 having stitching 24 (or alternatively, a plug inserted at distal ends of the outer cover member 2) to enclose at least one web of elastic material 22, such as for example, a bungee cord 22 received by and extending concentrically through a space defined by the outer cover member 2.

As illustrated in FIG. 5, In accordance with embodiments, the length of the bungee cord 22 is greater than the length of the outer cover member 2. This advantageously permits the cover member 2 to stretch longitudinally out to its maximum length before the bungee cord 22 so that the bungee cord 22 never reaches its maximum length. In this way, the overall service life of the bungee cord 22 is prolonged.

The outer cover member 2 and bungee cord(s) 22 advantageously permit the seating member 12, 14, when in the suspended position and occupied by at least one user, to move, for example simultaneously, in a vertical plane and a lateral plane with respect to the suspension point. In essence, the swing 20 is configured to move upwardly and downwardly while also pivoting about the suspension point.

By virtue of the fact the bungee cords 22 have the ability to stretch and the outer cover member 2 are configured to limit the stretch of the bungee cords 22 so that the bungee cords 22 never extend to their maximum length, the swing 20 provides a more stable and comfortable sitting area and can more safely swing or pivot about the suspension point.

As illustrated, in accordance with embodiments, a plurality of spring members may be used, each spring member 2, 22, 24 may be mechanically connected to the cross bar 4 at a respective first end via a first connector, and to an indoor or outdoor suspension point at a respective second end via a second connector. In accordance with embodiments, the second connector may be connected to a member (e.g., a chain, a chord, and the like) that permits suspension of the swing 20 to a support such as, for example, a tree. Embodiments, however, are not limited thereto and may encompass other types of connections that will fall within the spirit and scope of the principles of this disclosure.

In accordance with embodiments, the second suspension members may be modified based upon the weight of the user(s). For example, in some instances, the spring member may include an outer cover member 2 enclosing one bungee cord 22. In other instances, the outer cover member 2 may enclose two or more bungee cords 22 to compensate for the weight of the user(s).

In accordance with embodiments, the overall number of second suspension members 2 may be increased or decreased depending on the overall weight and/or number of users.

Additional Notes and Examples

Example One may include a recreational swing, comprising: a seating member having a base seat portion and a support seat portion to support the base seat portion; a suspension system connected to the base seating area to permit the seating member to be placed in a suspended position, the suspension system including a support cross bar, first suspension members each connected at a first end thereof to the seating member and at a second end to the support cross bar, and a second suspension members connected at first end thereof to the support cross bar to permit the seating member, when in the suspended position and occupied by at least one user, to move in a vertical plane and a lateral plane with respect to a suspension point.

Example Two may include the recreational swing of Example One, wherein the second suspension members each comprise: an outer cover member; and at least one web of elastic material received by the outer cover member, and which permits the seating member, when in the suspended position and occupied by at least one user, to move in a vertical plane and a lateral plane with respect to the suspension point.

Example Three may include the recreational swing of Example Two, wherein the at least one web of elastic material comprises a bungee cord.

Example Four may include the recreational swing of Example Three, wherein, the outer cover member is configured to limit the stretch of the bungee cord so that the bungee cord never extends to its maximum length.

Example Five may include the recreational swing of Example One, wherein each first suspension member comprises a nylon rope attached to the support seat portion at separate support points.

Example Six may include the recreational swing of Example One, wherein the base seat portion comprises a plurality of straps.

Example Seven may include the recreational swing of Example Six, wherein the support seat portion comprises a plurality of slots that receives a corresponding one of the straps to permit a removeable connection to the base seat portion.

Example Eight may include a recreational swing comprising: a seating member; a suspension system to permit the seating member to be placed in a suspended position, the suspension system including: a support cross bar; first suspension members spaced apart from each other and extending between the seating member and the support cross bar for connection thereto; and second suspension members connected to the support cross bar to permit the seating member, when in the suspended position and occupied by at least one user, to move in a vertical plane and a lateral plane with respect to a suspension point.

Example Nine may include the recreational swing of Example Eight, wherein the second suspension members each comprise: an outer cover member; and at least one web of elastic material received by the outer cover member, and which permits the seating member, when in the suspended position and occupied by at least one user, to move in a vertical plane and a lateral plane with respect to the suspension point.

Example Ten may include the recreational swing of Example Nine, wherein the at least one web of elastic material comprises a bungee cord.

Example Eleven may include recreational swing of Example Ten, wherein, the outer cover member is configured to limit the stretch of the bungee cord so that the bungee cord never extends to its maximum length.

Example Twelve may include the recreational swing of Example Eight, wherein each first suspension member comprises a nylon rope attached to the support seat portion at a first support point and a second support point.

Example Thirteen may include recreational swing of Example Eight, wherein the seating member comprises: a base seat portion having a plurality of straps; and a support seat portion to support the base seat portion, and which has a plurality of slots that receives a corresponding one of the straps to permit a removeable connection to the base seat portion.

Example Fourteen may include a recreational swing comprising: a seating member; and a suspension system to permit the seating member to be placed in a suspended position, the suspension system including suspension members to permit the seating member, when in the suspended position and occupied by at least one user, to move in a vertical plane and a lateral plane with respect to a suspension point.

Example Fifteen may include the recreational swing of Example Fourteen, wherein the suspension members each comprise: an outer cover member; and at least one web of elastic material received by the outer cover member, and which permits the seating member, when in the suspended position and occupied by at least one user, to move in a vertical plane and a lateral plane with respect to the suspension point.

Example Sixteen may include the recreational swing of Example Fifteen, wherein the at least one web of elastic material comprises a bungee cord.

Example Seventeen may include the recreational swing of Example Sixteen, wherein, the outer cover member is configured to limit the stretch of the bungee cord so that the bungee cord never extends to its maximum length.

Example Eighteen may include the recreational swing of Example Fourteen, wherein the seating member comprises: a base seat portion; and a support seat portion removeably connected to the base seat portion to support the base seat portion.

Example Nineteen may include the chair of Example Eighteen, wherein the seating member comprises: a base seat portion having a plurality of straps; and a support seat portion to support the base seat portion, and which has a plurality of slots that receives a corresponding one of the straps to permit a removeable connection to the base seat portion.

The term "coupled" or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A recreational swing, comprising:

a seating member having a base seat portion and a support seat portion to support the base seat portion, the base seat portion including a plurality of straps including a first strap spaced from a second strap at longitudinal ends of the base seat portion, and an intermediary third strap between the first strap and the second strap, the support seat portion including a plurality of slots that receives a corresponding one of the first strap and the second strap to permit a removable connection to the base seat portion along a longitudinal axis of the seating member, wherein the intermediary third strap is to wrap around the support seat portion to permit a removable connection to the base seat portion along a lateral axis of the seating member; and a suspension system connected to the support seat portion to permit the seating member to be placed in a suspended position, the suspension system including:

a support cross bar;

first suspension members each connected at a first end thereof to the seating member and at a second end to the support cross bar; and second suspension members connected at first end thereof to the support cross bar to permit the seating member, when in the suspended position and occupied by at least one user, to move in a vertical plane and a lateral plane with respect to a suspension point, the second suspension members each including an outer cover member, and at least one web of elastic material received by the outer cover member, wherein the outer cover member is configured to limit the length of the at least one web of elastic material to prevent the at least one web of elastic material from extending to a maximum length.

2. The recreational swing of claim 1, wherein the at least one web of elastic material comprises a bungee cord.

3. The recreational swing of claim 1, wherein each first suspension member comprises a nylon rope attached to the support seat portion at separate support points.

4. A recreational swing, comprising:

a seating member including a base seat portion having a first strap spaced from a second strap at longitudinal ends of the base seat portion, an intermediary third strap between the first strap and the second strap, and a support seat portion to support the base seat portion, the support seat portion having a plurality of slots that receives a corresponding one of the first strap and the second strap to permit a removable connection to the base seat portion along a longitudinal axis of the seating member, wherein the intermediary third strap is to wrap around the support seat portion to permit a removable connection to the base seat portion along a lateral axis of the seating member; and a suspension system to permit the seating member to be placed in a suspended position, the suspension system including a plurality of suspension members to permit the seating member, when in the suspended position and occupied by at least one user, to move in a vertical plane and a lateral plane with respect to a suspension point.

5. The recreational swing of claim 4, wherein the at least one web of elastic material comprises a bungee cord.

6. The recreational swing of claim 4, wherein each suspension member in the plurality of suspension members comprises a nylon rope attached to the support seat portion at a first support point and a second support point.

7. The recreational swing of claim 4, wherein each suspension member in the plurality of suspension members comprises a nylon rope attached to the support seat portion at separate support points.

8. A recreational swing, comprising:

a seating member having a base seat portion and a support seat portion to support the base seat portion, the base seat portion including a plurality of straps including a first strap spaced from a second strap at longitudinal ends of the base seat portion, and an intermediary third strap between the first strap and the second strap, the support seat portion including a plurality of slots that receives a corresponding one of the first strap and the second strap to permit a removable connection to the base seat portion along a longitudinal axis of the seating member, wherein the intermediary third strap is to wrap around the support seat portion to permit a removable connection to the base seat portion along a lateral axis of the seating member; and a suspension system connected to the support seat portion to permit the seating member to be placed in a suspended position, the suspension system including:

a support cross bar;

first suspension members each connected to the seating member and the support cross bar; and second suspension members connected to the support cross bar to permit the seating member, when in the suspended position and occupied by at least one user, to move in a vertical plane and a lateral plane with respect to a suspension point.

* * * * *